US005213921A

United States Patent [19]

Dove et al.

[11] Patent Number: 5,213,921

[45] Date of Patent: May 25, 1993

[54] ELECTROPHOTOGRAPHIC COLOR PRINTING PROCESS

[75] Inventors: Derek B. Dove, Mt. Kisco, N.Y.; Lawrence B. Schein, San Jose, Calif.

[73] Assignee: Lexmark International, Inc., Greenwich, Conn.

[21] Appl. No.: 827,851

[22] Filed: Jan. 30, 1992

Related U.S. Application Data

[63] Continuation of Ser. No. 632,293, Dec. 21, 1990, abandoned.

[51] Int. Cl.[5] ..... G03G 13/09

[52] U.S. Cl. ..... 430/42; 430/43; 430/44; 430/100

[58] Field of Search ..... 430/42, 43, 44, 100

[56] References Cited

U.S. PATENT DOCUMENTS

| | | | |
|---|---|---|---|
| 3,687,661 | 8/1972 | Sato et al. | 96/1.2 |
| 3,910,231 | 10/1975 | Inoue et al. | 118/637 |
| 4,078,929 | 3/1978 | Gundlach | 96/1.2 |
| 4,600,669 | 7/1986 | Ng et al. | 430/47 |
| 4,647,181 | 3/1987 | Kohyama | 430/42 |
| 4,804,602 | 2/1989 | Buettner et al. | 430/42 |
| 4,810,604 | 3/1989 | Schmidlin | 430/42 |
| 4,811,046 | 3/1989 | May | 355/4 |
| 4,841,335 | 6/1989 | Kohyama | 430/42 |
| 5,021,313 | 6/1991 | Alston | 430/42 |

OTHER PUBLICATIONS

M. Kohyama et al., High Speed Color Laser Printing Process, Journal of Imaging Technology, vol. 12, No. 1, Feb. 1986.

*Primary Examiner*—Marion E. McCamish
*Assistant Examiner*—Mark A. Chapman
*Attorney, Agent, or Firm*—John A. Brady

[57] ABSTRACT

The present invention relates to electrophotographic printing and, in particular, to a process for plural color electrophotographic printing with controlled deposition of each color during the printing process.

14 Claims, No Drawings

ELECTROPHOTOGRAPHIC COLOR PRINTING PROCESS

CONTINUATION APPLICATION

This application is a continuation of application Ser. No. 632,293 filed Dec. 21, 1991, now abandoned.

FIELD OF THE INVENTION

The present invention relates to electrophotographic printing and, in particular, to a process for plural color electrophotographic printing.

BACKGROUND OF THE INVENTION

Electrophotographic printing is generally known in the art. Typically, a photoconductive material is coated onto a drum or a belt to form a photoconductor. The photoconductor is provided with a uniform electrostatic charge in the absence of light using a suitable charging device. The photoconductor is then exposed to light by an imaging system which imagewise discharges the uniform electrostatic charge to form a latent electrostatic image corresponding to the information to be printed. Imaging systems include scanning laser beams and linear arrays of light-emitting diodes. The latent electrostatic image is developed with a resin powder, called toner to form a visible toner image on the photoconductor. The toner is then transferred to paper and the toner image is fixed to the paper by heating or by the action of solvents. In this way an image is obtained electrophotographically on plain paper.

In recent years, color electrophotographic systems have become commercially available. In the early systems, color printing and/or copying was carried out by laying down upon the paper substrate the different colored portions of the page separately and in succession until the desired full colored print was obtained. For each color, the normal electrophotographic steps were followed. However, the development station was changed in each color cycle so that the appropriate color was transferred to the photoconductor. Thus, each page of color printing required as many cycles as colors desired. This process was tedious and slow and there was a desire by those skilled in the art to decrease the number of cycles.

Gundlach, "Method for Two-color Development of a Xerographic Charge Pattern", U.S. Pat. 4,078,929, issued Mar. 14, 1978, the disclosure of which is incorporated herein by reference, discloses a process for creating multiple charge patterns on a photoconductor and developing the latent images with positive and negative charged toners in one cycle.

May, "Tri-level Highlight Color Printing Apparatus with Cycle-up and Cycle-down Control", U.S. Pat. No. 4,811,046, issued Mar. 7, 1989, the disclosure of which is incorporated herein by reference, discloses color electrophotography utilizing both charge and discharge area development.

Kohyama et al., "High-speed Color Laser Printing Process", Journal of Imaging Technology, Vol. 12, No. 1, Feb. 1986, pp. 47–52, discloses a discharge area development (DAD) method for achieving four color printing in a single cycle. Development is achieved by applying toner to the discharged areas of the photoconductor. The process provides that each layer of toner is retained on the photoconductor until the complete, fully colored image is built up. This is achieved by positioning around the photoconductor four development systems, four imaging systems, and four recharge coronas. After the full color toner image is built up on the photoconductor, it is then transferred to paper. In this case, the printing speed is equal to the black and white electrophotographic process speed.

In a commercially available Panasonic color copier, a different approach has been taken for the color electrophotographic process. As in the Kohyama process, the four color toner images are built up on the photoconductor with DAD development prior to a single transfer to paper. However, in this case the photoconductor rotates four times, once for each color, building up the color images in succession.

For both the Kohyama and Panasonic processes, the photoconductor must be recharged and re-exposed between each development step. It has been discovered that the toner layers adhering to the surface of the recharged photoconductor will cause a reduction in the net change in potential of the underlying photoconductor upon exposure to light. Thus, after the second exposure to light, the discharge potential of the photoconductor will vary depending on whether it has a toner overcoating. This variation in the potential of the discharged portion of the photoconductor will result in uneven deposition of the second and subsequent toners on the photoconductor with the effect of uncontrolled color variations.

It is the object of the present invention to provide a new process for plural color electrophotographic printing.

Other objects and advantages will become apparent from the following disclosure.

SUMMARY OF THE INVENTION

The present invention relates to a process for forming plural color images comprising: (a) charging a photoconductor, (b) exposing the photoconductor to light to discharge a first exposed area, (c) applying a first color of charged toner particles to the photoconductor (d) recharging the photoconductor with the first color toner particles adhering to the unexposed charged area of the photoconductor, (e) exposing the photoconductor to light to discharge a second exposed area, and (f) applying a second color of charged toner particles to the photoconductor to enable said second color toner particles to adhere to the second unexposed charged area of the photoconductor.

After the latent image on the photoconductor has been developed by the toners in accordance with the process of the present invention, it may be transferred to paper and permanently fixed to the paper by art-known techniques.

A more thorough disclosure of the present invention is presented in the detailed description which follows.

DETAILED DESCRIPTION OF THE INVENTION

The present invention relates to a process for forming plural color latent images on the surface of a photoconductor comprising the steps of: (a) charging the photoconductor, (b) exposing the photoconductor to light to discharge a first exposed area, (c) applying a first color of charged toner particles to the photoconductor, (d) recharging the photoconductor with the first color toner particles adhering to the unexposed charged area of the photoconductor, (e) exposing the photoconductor to light to discharge a second exposed area, and (f)

applying a second color of charged toner particles to the photoconductor to enable said second color toner particles to adhere to the second unexposed charged area of the photoconductor.

After the latent image on the photoconductor has been developed by the toners in accordance with the process of the present invention, it may be transferred to a substrate and fused to the substrate by art-known techniques.

The first step of the process of the present invention involves charging a photoconductor. Photoconductors are well known in the art. They generally comprise a charge transport layer, a charge generation layer, a ground layer such as aluminum, and a support layer of polymer such as poly (ethylene terephthalate). Suitable charge transport materials are known to those skilled in the art such as hydrazone, e.g., p-diethylaminobenzaldehyde 1,1 diphenylhydrazone, dispersed in a polymeric binder of polycarbonate or polyester Suitable charge generation materials include amorphous selenium and organic materials such as squarylium pigments, e.g., U.S. Pat. No. 3,824,099 and phthalocyanine pigments, e.g., U.S. Pat. No. 3,898,084. The photoconductor is commonly in the shape of a drum or belt and is conveniently charged in the dark by art-known techniques such as by the use of a corotron. Other charging techniques such as scorotron may also be utilized. The photoconductor is preferably given an electrostatic charge, e.g., a positive or negative charge and preferably a charge potential of from about 500 to about 1000 volts. Organic photoconductors are generally charged negative and selenium type photoconductors are generally charged positive.

In step 2 of the process of the present invention, using an imaging system, a predetermined area (representing the background of the image) of the photoconductor is exposed to electromagnetic radiation having a wavelength generally from about 0.9 to about 0.4 micrometers, preferably about 0.5 to about 0.85 micrometers, including radiation such as visible light, laser light, infra red light, and the like. The areas of the photoconductor which are exposed to light are discharged in accordance with an art-known phenomenon to a residual electrostatic potential of about 20 to about 200 volts, preferably about 40 to about 80 volts. The rest of the photoconductor remains at about the initial unexposed potential of from about 500 to about 1000 volts.

In step 3 of the process of the present invention, a first color of charged toner is brought into the proximity of the photoconductor drum and applied to the photoconductor. This toner is transparent to the subsequently applied imaging light. The sign of the charged toner is selected so it will adhere by electrostatic attraction to the unexposed charged areas of the photoconductor and not to the exposed discharged area of the photoconductor. The toner is applied to the photoconductor using art-known technology such as cascade development, magnetic brush development, monocomponent jump or contact development or other art known techniques. The toner adhering to the surface of the photoconductor does not cause any significant decrease of the electrostatic potential of the underlying photoconductor. Suitable toners for use in the present invention are known to those skilled in the art.

In step 4 of the process of the present invention, the photoconductor is recharged to an unexposed electrostatic potential of about 500 volts to about 1000 volts. The recharging process charges the entire photoconductor and the toner layer so that the photoconductor is fully charged to a uniform potential.

In step 5 of the process of the present invention, the photoconductor is again imagewise exposed to light. Any area of the photoconductor can be exposed to light in this second exposure, including those areas covered with a layer of toner and those areas that do not have a layer of toner. The first color toner is transparent to the imaging light to permit exposure of the underlying photoconductor. The areas of the photoconductor which are exposed to light are discharged to the residual electrostatic potential.

In step 6 of the process of the present invention, a second color of charged toner is applied to the photoconductor drum to adhere to the unexposed charged area of the photoconductor by electrostatic attraction. Preferably, the second color of charged toner is applied by the monocomponent jump development process. The second color toner may overlay the first color toner to provide a combination color in accordance with art known techniques for superposition of subtractive colors. For example, cyan plus magenta toners create a blue image. The area receiving toner during the second and any subsequent development steps is at a constant potential level relative to the development system potential, independent of the presence of a previously deposited toner layer. This is a major advantage in controlling the amount of toner delivered during the development process.

Having developed a two-color latent electrostatic image on the photoconductor, the image may be transferred to a substrate such as paper or plastic. The transfer is conveniently accomplished by art-known techniques such as by corona charging of the back of the substrate with a charge opposite to that of the toner particle. It may be desirable to add a pre-transfer corona to ensure all of the toner charge is the correct sign.

Lastly, the image may be fixed to the substrate by standard fusing technology such as heat and/or pressure to permanently affix the image to the substrate.

If it is desired to create images comprising more than two color toners, one of the following procedures may be utilized. First, prior to fusing the initial 2-color image to the substrate, the process of the present invention can be repeated and a second, 2-color latent image from the photoconductor can be transferred to the substrate with subsequent fusing of the 4-color image to the substrate. In this manner, four color toners can be fused onto the substrate at one time.

Alternatively, after the first 2-colors have been applied to the photoconductor in accordance with the process of the present invention, the photoconductor can again be recharged and reexposed two times to apply a third and fourth color to the photoconductor prior to transfer of the latent image to a substrate. However, those areas which are covered with toner and recharged in the second and subsequent cycle, may have potential drop across the toner layer resulting in the inability to completely discharge this area and a reduced background potential difference. This will result in either (a) increased background, or (b) if the development system bias is charged to maintain the background potential difference, in a reduced development potential. To facilitate the deposition of additional color toner layers, it is desirable to select a third and subsequent toner colors which are known in the art to be less visible to the eye such as yellow.

Although this invention has been described with respect to specific embodiments, the details thereof are not to be construed as limitations for it will be apparent that various embodiments, changes, and modifications may be resorted to without departing from the spirit and scope thereof, and it is understood that such equivalent embodiments are intended to be included within the scope of this invention.

We claim:

1. A process of forming plural color images on a photoconductor comprising the steps of:

(a) charging a photoconductor;

(b) exposing the photoconductor to light to discharge a first exposed area;

(c) apply a first color of charged, dry powder toner particles of potential to adhere to unexposed areas of said photoconductor to the photoconductor;

(d) recharging the photoconductor with the first color of charged toner particles adhering to the unexposed charged area of the photoconductor by repeating without change the charging operation which performed the foregoing step (a);

(e) exposing the photoconductor to light to discharge a second exposed area; and (f) applying a second color of charged, dry powder toner particles of potential to adhere to unexposed areas of said photoconductor to the photoconductor to enable said particles to adhere to the unexposed charged area of the photoconductor.

2. The process of claim 1 wherein said photoconductor is charged to a voltage of from about 500 volts to about 1000 volts.

3. The process of claim 2 in which both of said toners are color-subtractive.

4. The process of claim 2 wherein said photoconductor is charged to a negative potential.

5. The process of claim 4 in which both of said toners are color-subtractive.

6. The process of claim 4 wherein said photoconductor is discharged to a voltage of from about −20 volts to about −200 volts.

7. The process of claim 6 in which both of said toners are color-subtractive.

8. The process of claim 1 wherein the second color of charged toner particles is applied using jump development.

9. The process of claim 8 in which both of said toners are color-subtractive.

10. The process of claim 1 further comprising the step of transferring said first and second color toner particles to a substrate.

11. The process of claim 10 in which both of said toners are color-subtractive.

12. The process of claim 1 in which both of said toners are color-subtractive.

13. The process of claim 10 further comprising the step of fusing said toners to said substrate.

14. The process of claim 13 in which both of said toners are color-subtractive.

* * * * *